US005291251A

United States Patent [19]

Storlie et al.

[11] Patent Number: 5,291,251

[45] Date of Patent: Mar. 1, 1994

[54] IMAGE DEVELOPMENT AND TRANSFER APPARATUS WHICH UTILIZED AN INTERMEDIATE TRANSFER FILM

[75] Inventors: Chris A. Storlie; Thomas Camis; James G. Bearss, all of Boise, Id.

[73] Assignee: Hewlett-Packard Company, Palo Alto, Calif.

[21] Appl. No.: 992,394

[22] Filed: Dec. 17, 1992

[51] Int. Cl.[5] ..... G03G 15/14

[52] U.S. Cl. ..... 355/271; 355/212; 355/326 R

[58] Field of Search ..... 355/282, 256, 326, 327, 355/271, 212, 277, 279; 118/645; 346/157

[56] References Cited

U.S. PATENT DOCUMENTS

| | | | |
|---|---|---|---|
| 3,420,151 | 1/1969 | Levine et al. | 355/326 |
| 3,924,945 | 12/1975 | Weigl | 355/271 X |
| 3,937,572 | 2/1976 | Gaynor et al. | 355/212 X |
| 4,325,627 | 4/1982 | Swidler et al. | 355/256 |
| 5,057,875 | 10/1991 | Itoh | 355/326 |
| 5,166,734 | 11/1992 | Pinhas et al. | 355/271 X |

*Primary Examiner*—A. T. Grimley
*Assistant Examiner*—William J. Royer
*Attorney, Agent, or Firm*—E. F. Oberheim

[57] ABSTRACT

Image development and transfer apparatus for use in electrophotographic color printers and including a photoconductor, such as either a photoconductive drum or belt, which is spaced from sources of liquid color toners. An intermediate transport film is driven around a section of the photoconductor surface and between this surface and the sources of liquid color toners. Thus, the latent image developed on the surface of the photoconductor is transferred from the surface of the photoconductor to the outer surface of the intermediate transport film where the composite color image is developed. Then, this composite color image is transferred directly onto a print receiving media. Consequently, the photoconductor is not exposed to heat or carrier fluids during the image transfer and development process. This novel feature not only improves overall print quality on the printed media, but additionally extends the useful lifetime of the photoconductor. In a preferred embodiment of the invention, the intermediate transfer film is passed into contact with a conditioning squeegee roller of a selected material during each pass around the photoconductor in order to compress the developed image on the film and enhance the image quality thereof. Also, in a preferred embodiment of the invention, the intermediate transfer film comprises a first main layer of a polyester material and a thin outer release layer of either a fluorosilicon material or a cross-linked siloxane material.

3 Claims, 3 Drawing Sheets

IMAGE DEVELOPMENT AND TRANSFER APPARATUS WHICH UTILIZED AN INTERMEDIATE TRANSFER FILM

TECHNICAL FIELD

This invention relates generally to electrophotographic color printing and more particularly to such printers which use an image transfer member located between a photoconductive drum or photoconductive belt and the image receiving media.

BACKGROUND ART AND RELATED PATENT

In the field of electrophotographic color printing using liquid color toners, two different technologies have been developed for transferring a developed color image from the surface of a photoconductive drum or belt to an adjacent print media. One of these two technologies uses a direct transfer method wherein the unprinted media is passed directly between the surface of a photoconductive drum or belt and a transfer roller where a color image is directly transferred from the surface of the photoconductive drum or belt to the media. One example of such a direct transfer process is disclosed and claimed in the Camis U.S. Pat. No. 5,115,277 issued May 19, 1992, and entitled "Electrostatically Assisted Transfer Roller and Method for Directly Transferring Liquid Toner to a Print Medium", assigned to the present assignee and incorporated herein by reference.

The other of these two technologies uses an intermediate transfer member (ITM) which is positioned between the surface of a photoconductive drum and a transfer roller and is operative firstly to receive the developed color image from the surface of the photoconductive drum and secondly to transfer the developed color image from its own surface to the media which passes between the surface of the intermediate transfer member and an adjacent transfer roller.

One disadvantage of using either one of the above two image transfer methods is that the photoconductive drum material must be insensitive to a carrier fluid, such as an Isopar or equivalent carrier fluid as well as submicron toner particles. In addition, in the direct transfer case, the photoconductive drum should also possess a surface preferably having more or less ideal release properties in order to eliminate toner adhesion problems. Other important factors when using a direct transfer process are that direct transfer methods require some means for heating the media, and this requirement in turn can cause both physical and electrical damage to the photoconductive drum material.

It should also be mentioned that in either the above direct transfer or indirect transfer cases, the toner charge level is an extremely important parameter inasmuch as it has a direct critical effect upon toner mass transfer. Using the intermediate transfer method, this process is also not immune to heat damage problems, and a high level of toner charge control is required since this charge control also controls the electrostatic transfer of the liquid color toners from the surface of the photoconductive drum to the intermediate transfer member. However, the direct transfer method of image processing is even more dependent upon the toner charge level since it requires very specific levels of voltage on the photoconductor in order to achieve optimal toner-on-toner multi-layer development. These levels of toner charge are also critical to the direct transfer of color images to the media. Also, the use of these direct transfer techniques has an additional problem in that the media comes into direct contact with the photoconductor, and this can cause undesirable wear on the photoconductor.

DISCLOSURE OF INVENTION

The general purpose and principal object of the present invention is to provide a novel alternative color image transfer approach with respect to both of the above two prior art processes for image transfer and one which overcomes many of the above described disadvantages of these two prior art image transfer methods. As will be described in more detail herein, the method and apparatus of the present invention utilizes an intermediate transfer film or belt (ITF herein) which is driven around the surface of a photoconductor and then passes into direct contact with the media where the color image transfer takes place.

Another object of this invention is to provide a new and improved ITF method and apparatus of the type described wherein no special release layer is required for the organic photoconductive drum and also wherein no heat need be applied to the surface of the organic photoconductive drum.

Another object of this invention is to provide a new and improved ITF method and apparatus of the type described which can use direct contact roller charge, thereby producing very low levels of ozone.

Another object of this invention is to provide a new and improved ITF method and apparatus of the type described wherein the organic photoconductive drum receives a minimal amount of wear and requires no cleaning during operation.

Another object of this invention is to provide a new and improved ITF process of the type described which does not require image exposure through colored toner layers. That is to say, the present process does not use toner-on-toner on the organic photoconductor surface, but rather toner-on-toner on the intermediate transfer film.

Another object of this invention is to provide a new and improved ITF process of the type described which operates to increase the lifetime of the organic photoconductor (OPC) inasmuch as there is no physical abuse to the OPC, thereby extending its life to electrostatic cycling limits. In addition, the OPC is not exposed to a cleaner station, and this fact also contributes to OPC lifetime extension.

Another object of this invention is to provide a new and improved ITF method and apparatus of the type described wherein no specific net charge is required on the toner after image development, and wherein there is no need to optimize electrostatic conditions during image transfer.

Another object of this invention is to provide a new and improved ITF method and apparatus of the type described wherein image transfer may be accomplished through the use of thermal and mechanical pressures alone, without the further requirement for (optional) electrostatically assisted image transfer.

Another object of this invention is to provide a new and improved ITF method and apparatus of the type described wherein the media may be heated before it reaches the nip zone between a pair of transfer rollers through which the intermediate transfer film or belt passes. This option has the effect of giving improved control and flexibility of media heating during the image transfer process.

Among the novel features of the present invention are included the following:

1. Full color monochromatic or achromatic high quality output is achieved.

2. No special photoconductor materials set is required, and there is no direct contact of the photoconductive material with toner fluids or toner particles or cleaning apparatus.

3. The photoconductive drum is not subjected to any direct heating, and therefore its useful lifetime is extended.

4. The exposure of the photosensitive member is not impeded by the film structure inasmuch as the exposing is done from the inside of the film so that the exposure through toner layers on the transport film is not required.

5. Organic photoconductors are preferred, but they are not required.

6. Both discharge area development (DAD) and charge area development (CAD) processes can be used.

7. The printer footprint can be made relatively small if a photoconductor belt is used, and this feature will allow ideal positioning for developer assemblies.

8. Direct contact roller charging of the photoconductor can be used, and this feature eliminates high levels of ozone and is much less expensive than known prior art methods and requires no maintenance.

9. Image transfer is less sensitive to media differences, and the ITF transfer process will be more dependent on thermal and mechanical pressures with less influence given to electrostatic pressures, thereby making the electrostatic assist process of the above identified U.S. Pat. No. 5,115,277 optional.

10. The present invention may be used with both liquid color toners and dry powder color toners.

Therefore, briefly summarizing the invention as broadly claimed herein, the described method and apparatus herein utilize a photoconductor mounted to receive a beam of monochromatic light for writing an image on the surface thereof, and liquid or dry color toner development means are spaced a certain distance away from the photoconductor. An intermediate transfer film is driven around a predetermined area of the photoconductor and between the photoconductor and the toner development means where color images of cyan, magenta, yellow, and black are transferred from the photoconductor and onto and through the intermediate transfer film and thereby developed, one on top of another, on the outside surface of the intermediate transfer film. Then, after four (4) passes around the photoconductive drum or belt, the intermediate transfer film is brought into direct contact with the color image-receiving media where the composite color image is transferred to the media. In a preferred embodiment of the invention, the intermediate transfer film is passed into contact with a conditioning or squeegee roller once each pass around the photoconductor.

In accordance with the broad method claims filed herein, the present invention is directed to a method for developing and transferring color images to print media and comprises the steps of: passing an intermediate transfer film (ITF) between a photoconductor surface and sources of liquid color toner for developing a composite color image on the outer surface of the ITF film, and then passing the film into direct contact with a chosen print media for transferring the composite color image thereto.

In one embodiment of the invention, the above photoconductor consists of a rotating photoconductive drum, and in another embodiment of the invention, the photoconductor consists of a photoconductive belt which is driven around two spaced-apart rollers and around which the intermediate transfer or inter-position film passes as it traverses a path first extending past the conditioning or squeegee roller and then extending between the first and second transfer rollers.

The above brief summary of the invention, together with its many attendant advantages, objects, and novel features will become better understood with reference to the following description of the accompanying drawings.

DETAILED DESCRIPTION OF THE DRAWINGS

Figure 1A:
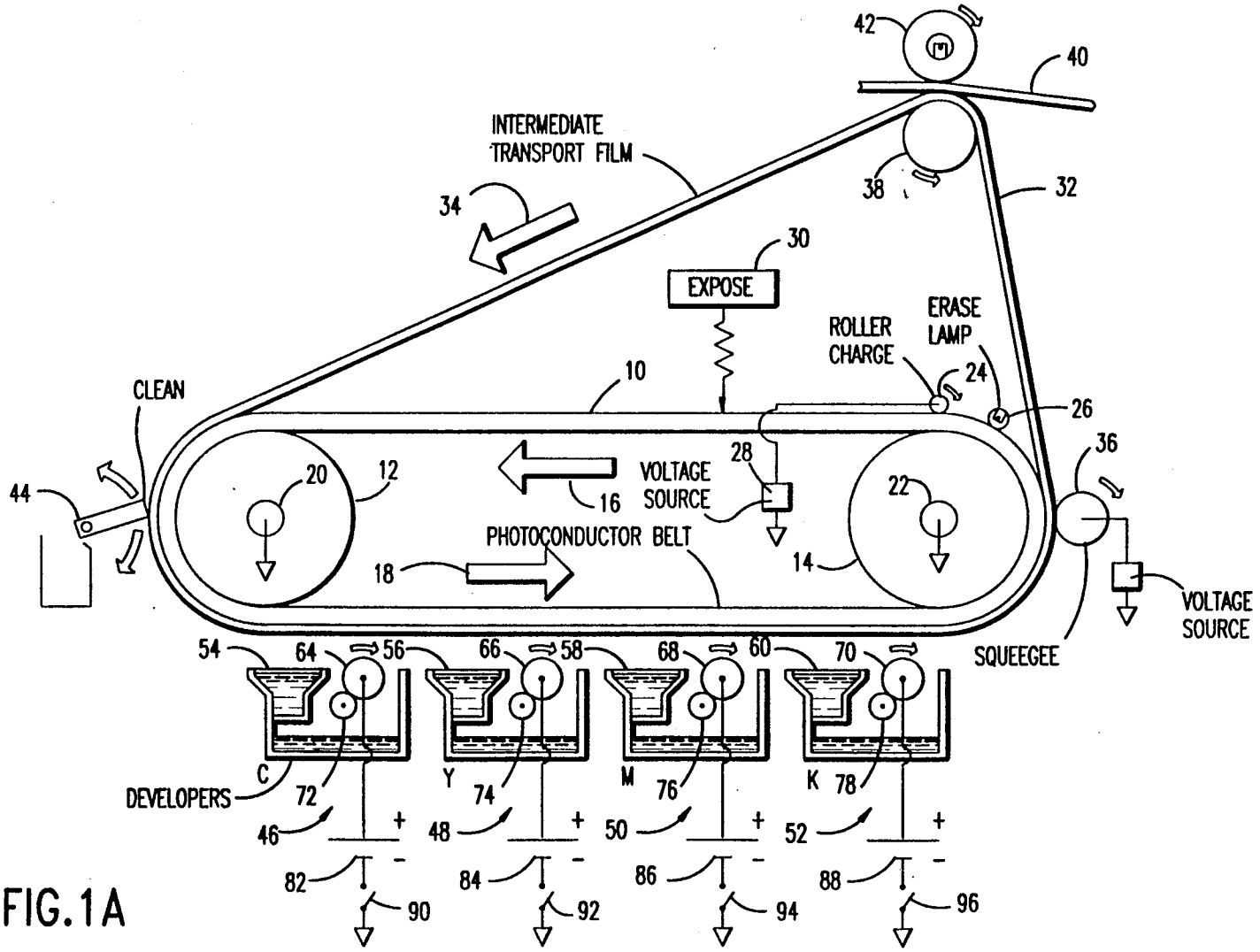
FIG. 1A is a schematic cross-sectional view showing a first embodiment of the invention utilizing a photoconductive belt, an intermediate transfer film, and a plurality of liquid toner developer and distribution stations for developing the cyan, yellow, magenta, and black color toner images in sequence on the intermediate transfer film.

Referring now to FIG. 1A, there is shown a photoconductive belt 10 which is wound around a pair of drive rollers 12 and 14 and, in operation, driven in the direction of the arrows 16 and 18. Each of the drive rollers 12 and 14 includes an inner core axial drive member 20 and 22, and the outer surface of the photoconductive belt 10 is provided with a charge roller 24 and an erase lamp 26. The charge roller 24 is connected through an AC and DC charging voltage source 28 to a point of reference or ground potential. A writing source 30 of laser light or a light emitting diode (LED) array is positioned as shown above the upper surface of the photoconductive belt 10 and is operative in a conventional manner to develop latent images on the surface of the photoconductive belt 10. In the embodiment of the invention as shown in FIG. 1A, discharge area development (DAD) is used to develop a latent image on the surface of the photoconductive belt 10 by discharging the positively charged photoconductive belt 10 which was previously charged by the charge roller 24. The areas of the photoconductive belt 10 which are discharged by the laser source 30 define the latent image on the outer surface thereof.

The intermediate transfer film (ITF) 32 is positioned as shown around the side and lower surface areas of the photoconductive belt 10 and moves in the direction of the arrow 34 when driven past the C, Y, M, and K liquid developers 46, 48, 50, and 52 described below and adjacent to the surface of a squeegee roller 36, then around one surface area of an idler roller 38 and between the idler roller 38 and the print media 40. The print media 40 in turn is operatively driven between the upper surface of the intermediate transport film 34 and a heated transfer roller 42 which will be raised upwardly out of physical contact with the print receiving media until all of the cyan, yellow, magenta, and black color plane images have been transferred from each liquid color toner source and developed, one upon another, to form a composite C, Y, M, and K color image on the ITF film 32. Then, the heated transfer roller 42 will be lowered into contact with the print receiving media and compressed against the ITF film in order to transfer the composite color image onto the media. The heated transfer roller may, for example, be of the type disclosed and claimed in U.S. Pat. No. 5,136,334 issued to Thomas Camis, assigned to the present assignee and incorporated herein by reference.

The idler roller 38 rotates counter clockwise as indicated, whereas the transfer roller 42 is driven clockwise in order to drive the printed media 40 from right to left as viewed in FIG. 1A. The intermediate transfer film 32 is provided on the left hand side of FIG. 1A with an optional cleaning blade 44 which operates to clean toner off of the surface of the intermediate transfer film 32 once each revolution around the photoconductive belt 10.

The printing apparatus shown in FIG. 1A is further provided with a plurality of liquid color toner sources indicated generally at 46, 48, 50, and 52. Each of these color sources for the cyan, yellow, magenta, and black colors, respectively, will contain a liquid color toner reservoir 54, 56, 58, and 60, and a corresponding developer roller 64, 66, 68 and 70 positioned as shown within the liquid color toner sources 46, 48, 50, and 52. Each of these liquid toner sources further includes a cleaning roller of a selected foam cleaning material 72, 74, 76, and 78, each of which are rotated in the same direction as the adjacent developer roller 64, 66, 68, and 70 in order to provide the appropriate scrubbing and cleaning action at the surface of each corresponding developer roller 64, 66, 68, and 70.

Each developer roller is connected respectively, through sources 82, 84, 86 and 88 of DC bias which are selectively switched and energized through the corresponding switches 90, 92, 94, and 96 to sequentially energize each of the C, Y, M, and K developer rollers which operate to receive liquid color toner. This toner is pumped or drawn out of the tops of the respective reservoirs 54, 56, 58, and 60, and onto the rotating surfaces of the corresponding developer rollers 64, 66, 68, and 70 during the sequential operation of each of these color toner sources 46, 48, 50, and 52 during the color image development operation described below. Each of the developer rollers 64, 66, 68, and 70 is spaced about 2–10 mils from the surface of the intermediate transfer film 32 and operates to uniformly distribute liquid color toners which will typically consist of a NORPAR TM carrier fluid containing color toner particles. This carrier fluid is preferably an isoparaffinic hydrocarbon such as a blend of 2-methylalkanes between C10–C14. In a preferred embodiment of the invention, the toner includes polymeric resin coated pigments suspended in an isoparaffinic dispensing medium having a charge directional agent or functional group. The charging agent acts in such a way as to provide the pigmented toner with a sufficiently high net charge to form a high quality image on the intermediate transport film 32.

Liquid color toner sources such as those described above with reference to FIG. 1A above are also described, for example, in copending application Ser. No. 07/904,798 of John A. Thompson, filed September 1992 and entitled "Liquid Electrophotographic Printer Developer", assigned to the present assignee and also incorporated herein by reference.

Figure 1B:
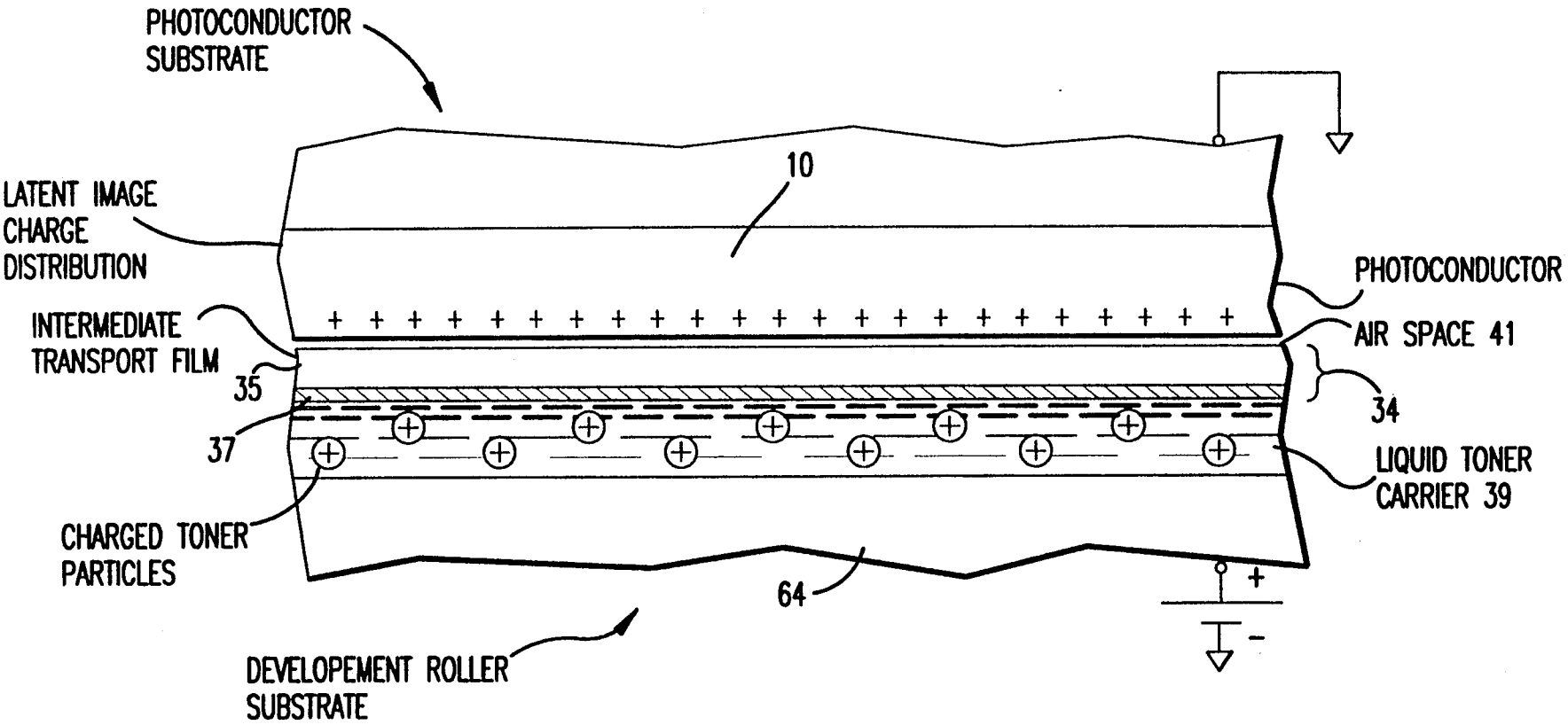
FIG. 1B is an enlarged and fragmented cross-sectional view showing the combination photoconductor layer and intermediate transfer film materials as they are situated adjacent to the cyan, yellow, magenta, and black (C, Y, M, K) developer rollers in each of the color development stations in FIG. 1A, respectively.

Referring now to FIG. 1B, during the development of each of the four color images, a positive DC voltage applied in sequence to each developer roller 64, 66, 68, or 70 will have the effect of electrostatically forcing the liquid color toner on the areas of the intermediate transfer film 32 which are immediately adjacent to the discharged developed areas on the photoconductive belt 10. These are the areas on the belt 10 which were discharged by the laser source 30 to thereby produce the latent image on the surface of the photoconductive belt 10. If a transparent ground plane such as indium tin oxide were used, the laser exposure 30 could take place through the backside of the photoconductor substrate 10, thereby allowing a more flexible system configuration. Thus, as shown in FIG. 1B, the charged toner particles are repelled by the positive DC voltage on each developer roller in each of the four color toner sources and projected onto the outer lower facing surface of the intermediate transfer film 32. However, these positively charged toner particles are repelled by the non-discharged positive ions remaining on the photoconductive belt 10 during this image transfer operation.

Referring again to FIG. 1B, there is shown in an enlarged fragmented cross-sectional view the novel materials set used in a preferred embodiment of the invention for constructing the intermediate transport film 34. The intermediate transfer film 34 preferably consists of a first or main support layer 35 upon which a thin release layer 37 is disposed. This thin release layer 37 is operative to receive the liquid toner carrier 39 transferred from each of the four developer rollers 64, 66, 68, and 70. There will be a thin air space 41 of about 2–5 microns as indicated between the downwardly facing surface of the photoconductive belt 10 and the upwardly facing surface of the main support layer 35 of the intermediate transport film 34. In a preferred embodiment of the invention, the first or main support layer 35 of the intermediate transport film will be a polyester material such as a polyimide film on the order of about one-quarter ($\frac{1}{4}$) to one-half ($\frac{1}{2}$) mils (6.35 microns to about 12.7 microns) in thickness. The thin release layer 37 will preferably be either a fluorosilicon material or a cross-linked siloxane material on the order of about 3 micrometers in thickness. The photoconductive belt 10 is an organic photoconductive material such as a single layer of phthalocyanine, but other photoconductive materials may be used as well.

Figure 2:
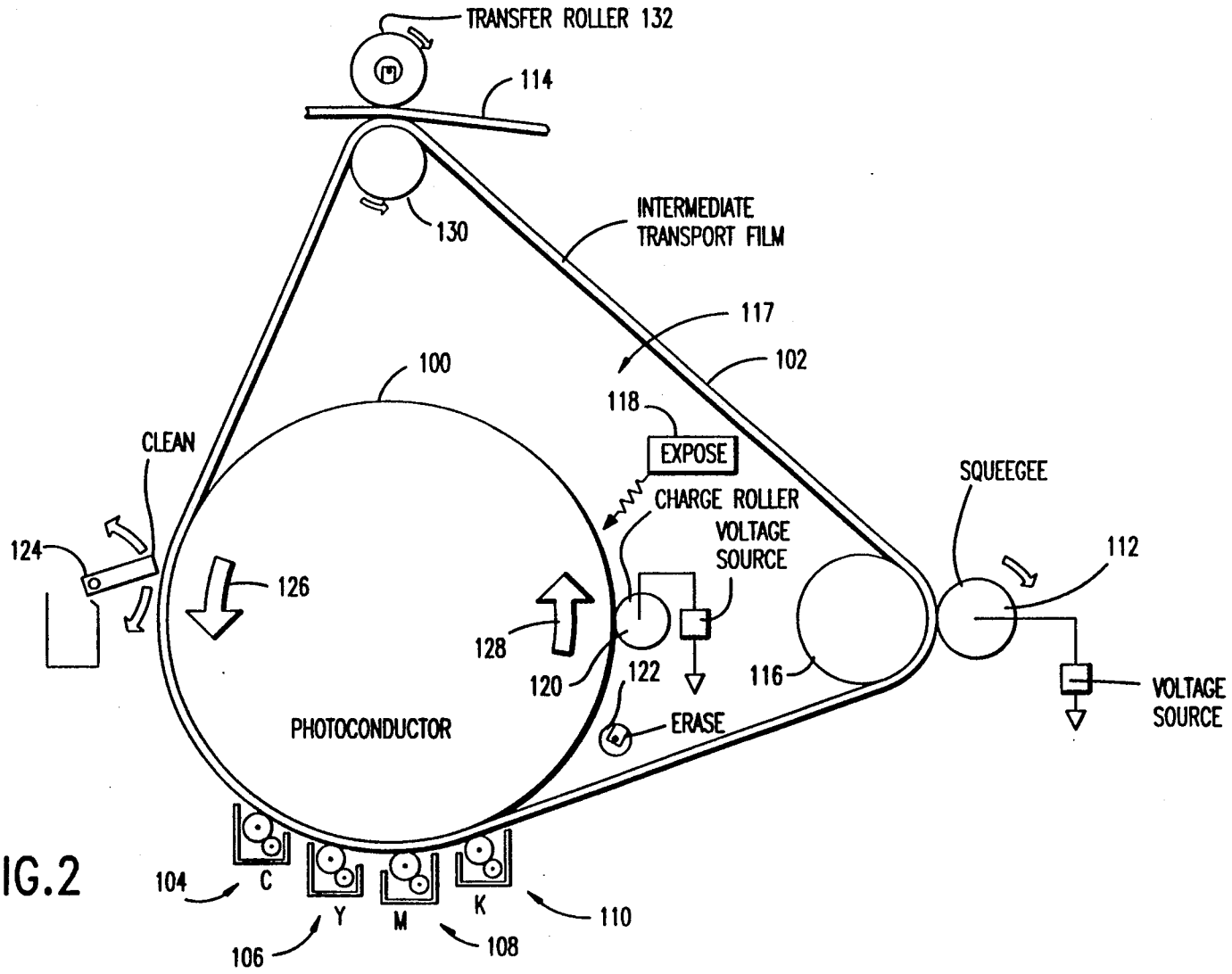
FIG. 2 is an abbreviated schematic cross-sectional view of a second embodiment of the invention wherein the photoconductive belt in FIG. 1A has been replaced with a photoconductive drum.

Referring now to FIG. 2, there is shown a second embodiment of the present invention wherein a photoconductive drum 100 has been used to replace the photoconductive belt 10 in FIG. 1. An intermediate transfer film 102 is positioned as shown to pass between a plurality of liquid color toner sources 104, 106, 108, and 110, and is then passed by a squeegee conditioning roller 112 before reaching the print media 114. In this embodiment of the invention, and due to the different mechanical configuration of the various components used, an idler roller 116 is now required as shown adjacent the squeegee roller 112 in order to define the necessary space 117 for receiving the laser source 118 for developing the latent image. Similar to the construction of FIG. 1A, a photoconductive drum charging roller 120 and an erase lamp 122 are provided as indicated on the right hand side of the photoconductive drum 100, and a cleaning blade 124 is mounted on the left hand side of the intermediate transfer film 102.

As indicated by the two arrows 126 and 128, the photoconductive drum 100 is rotated in a counter clockwise direction, and the two idler rollers 116 and 130 and the heated transfer roller 132 are rotated in the direction of their associated arrows. This motion drives the intermediate transfer film 102 in a counter clockwise direction when each of the cyan, yellow, magenta, and black color images are developed in series, one upon another, on the surface of the intermediate transfer film 102 before the film 102 is brought into contact with the print media 114 passing as shown from right to left between the idler roller 130 and transfer roller 132.

Various modifications may be made in and to the above described embodiments without departing from the spirit and scope this invention. For example, the exact size, shape, and geometrical configurations of the belt driven apparatus of FIG. 1A and drum driven apparatus of FIG. 2 may be varied in accordance with certain operational and performance requirements. These modifications may also include variations in the specific construction of both the multi-layer intermediate transport film 34 shown in FIG. 1B, the particular mechanical design of the various color sources shown in FIG. 1A as well as variations in types of liquid toner used. Also, the present invention is not limited to the use of liquid color toners and may also be used with dry powder toners. In addition, the present invention may be practiced by heating the lower drive roller 38 instead of the upper transfer roller 42. Also, the present invention is not limited to the particular film thicknesses specified for the photoconductive belt 10, and this photoconductive belt 10 can, if desired, be operated in a back-and-forth shuttle motion during the above sequential development of color images. Accordingly, such constructional and design modifications are clearly within the scope of the following appended claims.

We claim:

1. A color image development system for transferring a composite color image from a photoconductive drum or belt to print receiving media and utilizing a plurality of color toner development and distribution stations for supplying liquid color tones of cyan, yellow, magenta, and black onto a developed latent image, characterized in that: an intermediate transfer film or belt is operatively positioned between a surface area of said photoconductive drum or belt and said stations for supplying liquid color toners and comprises a first main layer comprising a polyester material for location adjacent to said photoconductive drum or belt and a second outer release layer comprising either a fluorosilicon material or a cross-lined liloxane material disposed on an outer surface of said first main layer, whereby a composite color image is developed on said outer release layer from where it is transferred onto print receiving media.

2. The system defined in claim 1 wherein said first main layer is in the range of one-quarter (¼) to one-half (½) mil in thickness and said outer release layer is on the order of about 3 micrometers in thickness.

3. Image development and transfer apparatus for an electrophotographic color printer including, in combination:

a. movable photoconductive means mounted for receiving a beam of light for writing an image onto the surface thereof, b. toner development means spaced from said photoconductive means, c. an intermediate transfer film around a section of said photoconductive means and movable therewith between said photoconductive means and said toner development means for receiving a composite color image from said photoconductive means and through said intermediate transfer film and color-developed on the outside surface of said intermediate transfer film, and d. said intermediate transfer film comprises a first main layer for location adjacent to a surface area of said photoconductive means and a second, outer release layer disposed on an outer surface of said first main layer, whereby a composite color image is developed on said outer release layer, e. said first main layer of said intermediate transfer film is a polyester material between one-quarter (¼) and one-half (½) mils in thickness and said outer release layer is either a fluorosilicon material or a siloxane material on the order of about 3 micrometers in thickness, and f. means for transferring said composite color image to print receiving media.

* * * * *